US010794647B2

(12) United States Patent
Lage

(10) Patent No.: US 10,794,647 B2
(45) Date of Patent: Oct. 6, 2020

(54) BOLT CONVERSION APPARATUS FOR FIREARM AND UPPER RECEIVER FOR THE SAME

(71) Applicant: Richard Wilson Lage, Chandler, AZ (US)

(72) Inventor: Richard Wilson Lage, Chandler, AZ (US)

( * ) Notice: Subject to any disclaimer, the term of this patent is extended or adjusted under 35 U.S.C. 154(b) by 0 days.

(21) Appl. No.: 16/583,659

(22) Filed: Sep. 26, 2019

(65) Prior Publication Data

US 2020/0096268 A1 Mar. 26, 2020

Related U.S. Application Data

(60) Provisional application No. 62/737,054, filed on Sep. 26, 2018.

(51) Int. Cl.
*F41A 3/66* (2006.01)
*F41A 3/82* (2006.01)
*F41A 19/12* (2006.01)

(52) U.S. Cl.
CPC ..... *F41A 3/66* (2013.01); *F41A 3/82* (2013.01); *F41A 19/12* (2013.01)

(58) Field of Classification Search
CPC ..... F41A 3/64; F41A 3/66; F41A 3/82; F41A 11/02
See application file for complete search history.

(56) References Cited

U.S. PATENT DOCUMENTS

| | | | | | |
|---|---|---|---|---|---|
| 4,028,993 | A * | 6/1977 | Reynolds | F41A 3/78 | 89/130 |
| 4,057,003 | A * | 11/1977 | Atchisson | F41A 3/26 | 89/138 |
| 4,069,607 | A * | 1/1978 | Jurek | F41A 15/14 | 42/25 |
| 8,453,367 | B2 * | 6/2013 | Overstreet | F41A 29/02 | 42/108 |
| 8,464,453 | B1 * | 6/2013 | Ubl | F41A 3/36 | 42/15 |
| 8,800,424 | B2 * | 8/2014 | Gangl | F41A 3/84 | 89/198 |
| 8,899,141 | B2 * | 12/2014 | Reynolds | F41A 5/12 | 89/129.01 |
| 10,215,513 | B2 * | 2/2019 | Cross | F41A 17/38 | |
| 2019/0293379 | A1 * | 9/2019 | Taylor | F41A 3/82 | |

FOREIGN PATENT DOCUMENTS

| | | | | |
|---|---|---|---|---|
| GB | 1138423 | A * | 1/1969 | F41A 5/18 |

* cited by examiner

*Primary Examiner* — Joshua T Semick
(74) *Attorney, Agent, or Firm* — Dobbin IP Law P.C.; Geoffrey E. Dobbin

(57) ABSTRACT

An upper receiver for the one family of firearms allows for the use of a bolt of another firearm family in the firearm action. In the depicted embodiment, an AR-15 bolt and its carrier group are simple drop-in with only the addition of a sear plate, clamp, and an insert into the bolt carrier group. The depicted receiver is designed to also prevent its use on the semi-automatic variants of the MAC family.

9 Claims, 11 Drawing Sheets

BOLT CONVERSION APPARATUS FOR FIREARM AND UPPER RECEIVER FOR THE SAME

CROSS-REFERENCES TO RELATED APPLICATIONS

This Application claims priority as a non-provisional perfection of prior filed U.S. Application 62/737,054, filed Sep. 26, 2019, and incorporates the same by reference herein in its entirety.

FIELD OF THE INVENTION

The present invention relates to the field of firearms and more particularly relates to an upper receiver for a firearm which allows the bolt of one family of firearms to be used with another.

BACKGROUND OF THE INVENTION

Firearms have a long and storied past in the prior art. From the first simple barreled cannons to modern automatic weapons, many innovations have been made in the art. One of the most important changes in the art of the modern firearm is the specialization of parts used in various families of weapons. As such, parts which are suitable for an AK or similar firearm are not usually suitable for a FAL. However, there are times when the use of a particular component may be justified in its use in another system. As such, adapting one system to make use of another system's components does have some utility. Current systems which allow such conversions, both known and in development, involve extensive modification to the bolt and/or the receiver in order to make the system work. As a result, the AR-15 bolt carrier group is installed or removed only with great and extensive removal of hardware. It is not a drop-in system as it would be in its original firearm family, which is what the general populace expects. What is needed is a system which, even if it replaces the upper receiver, allows the AR-15 bolt carrier group to drop in and be easily replaced.

The present invention is an upper receiver which adapts the family of MAC (Military Armament Company) submachine guns to use a bolt from an AR-15. This modification must be carefully achieved as it is intended, for legal purposes, to only be used on the fully automatic variants of the MAC family, and not the semi-automatic variants. The present invention represents a departure from the prior art in that the upper receiver of the present invention allows for a drop-in replacement of the MAC bolt with an AR-15 bolt in a specialized carrier.

SUMMARY OF THE INVENTION

In view of the foregoing disadvantages inherent in the known types of bolt adaptations, an improved upper receiver that allows a replacement AR-15 bolt and its associated carrier group to be dropped in without extensive modification or entangling hardware.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also, it is to be understood that the phraseology and terminology employed herein are for description and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

With reference now to the drawings, a preferred embodiment of the upper receiver is herein described. It should be noted that the articles "a", "an", and "the", as used in this specification, include plural referents unless the content clearly dictates otherwise.

Figure 1:
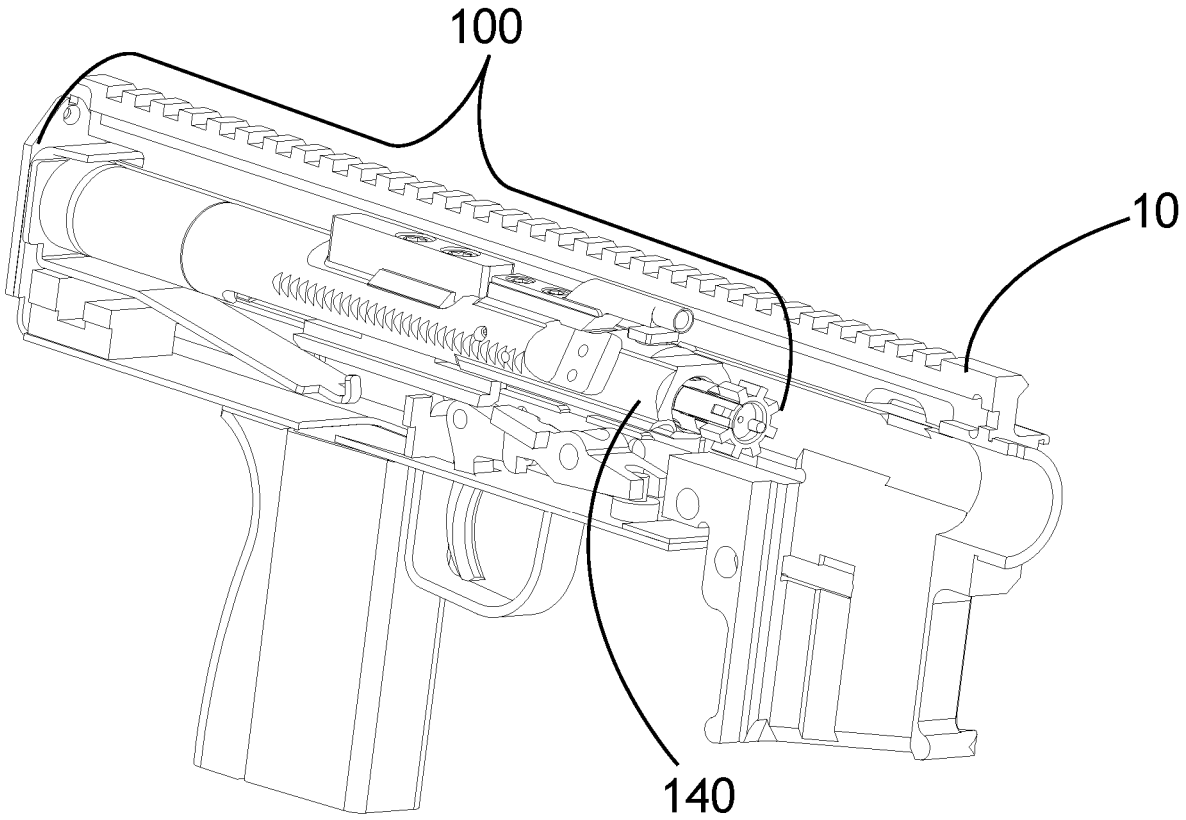
FIG. 1 is a cut-away view of a MAC firearm with an upper receiver of the present invention and a modified AR-15 bolt carrier group.
Figure 2A:
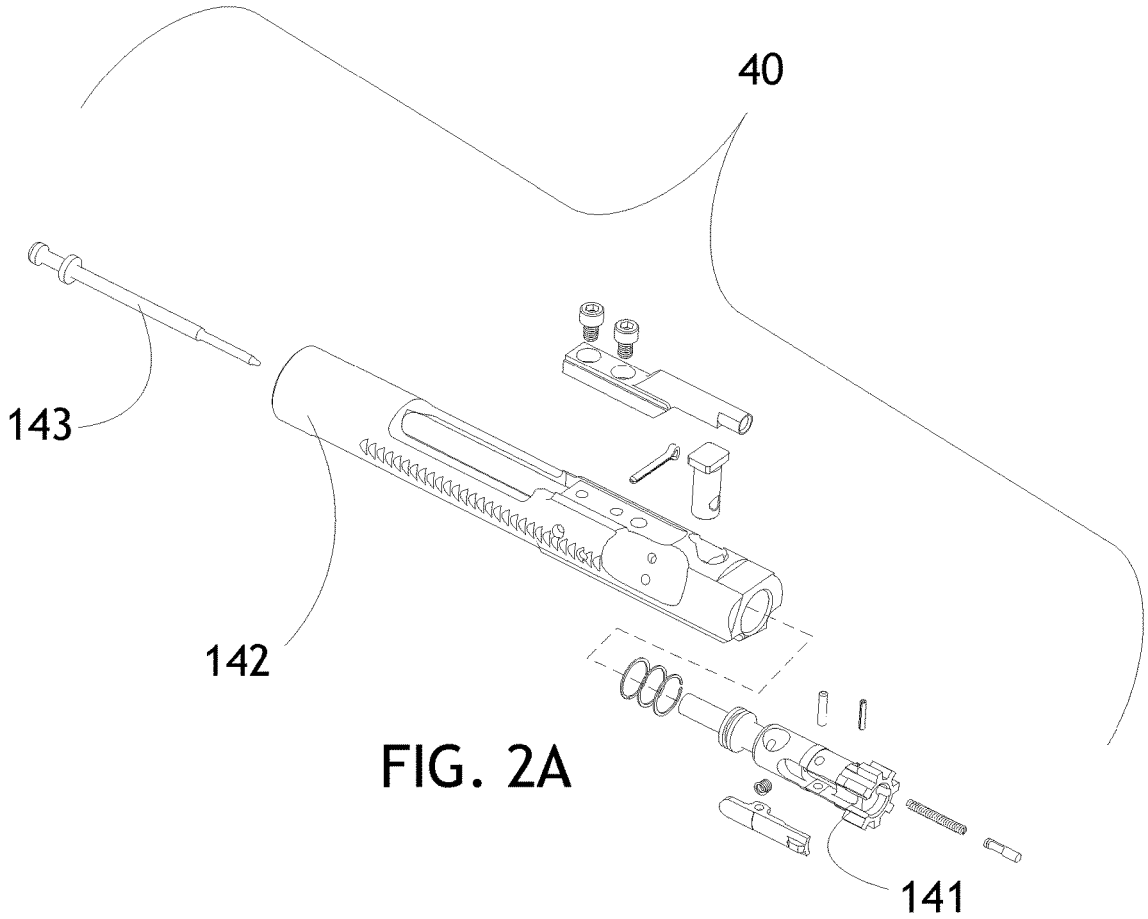
FIG. 2A is an exploded view of a conventional AR-15 bolt carrier group.
Figure 2B:
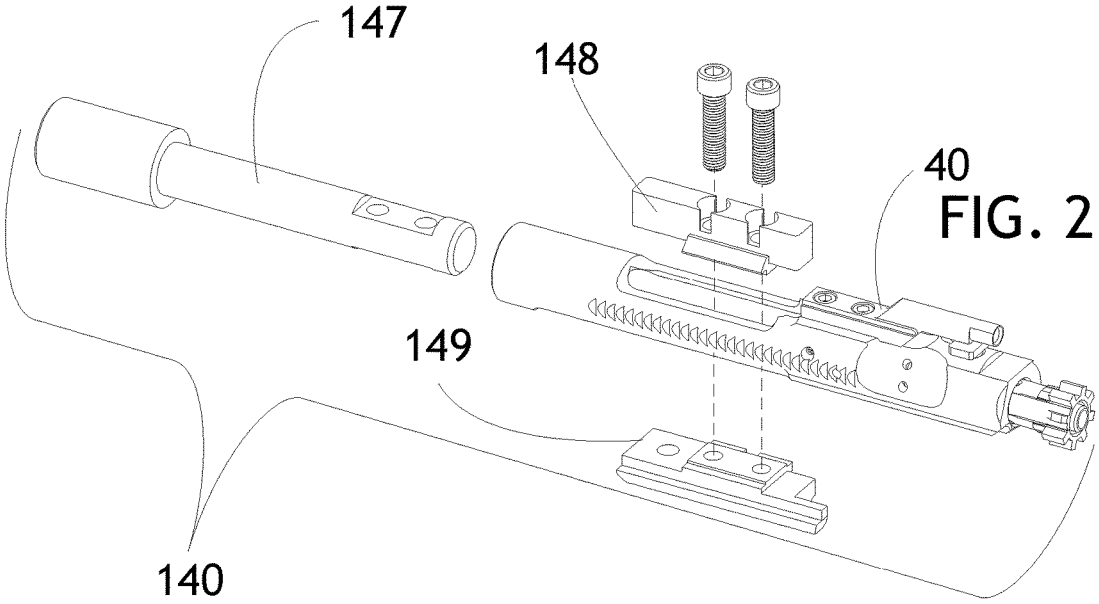
FIG. 2B is an exploded view of a modified AR-15 bolt carrier group for use in a MAC-family firearm.
Figure 3:
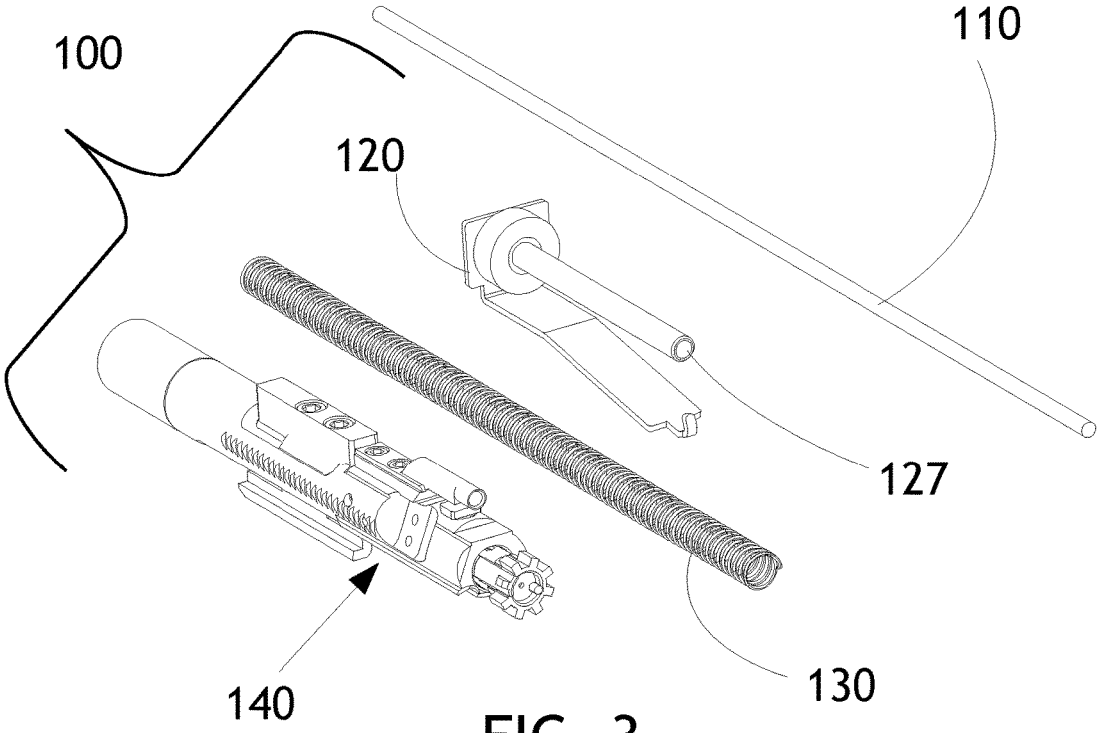
FIG. 3 is an exploded view of the bolt carriage unit and installation rod.
Figure 4:
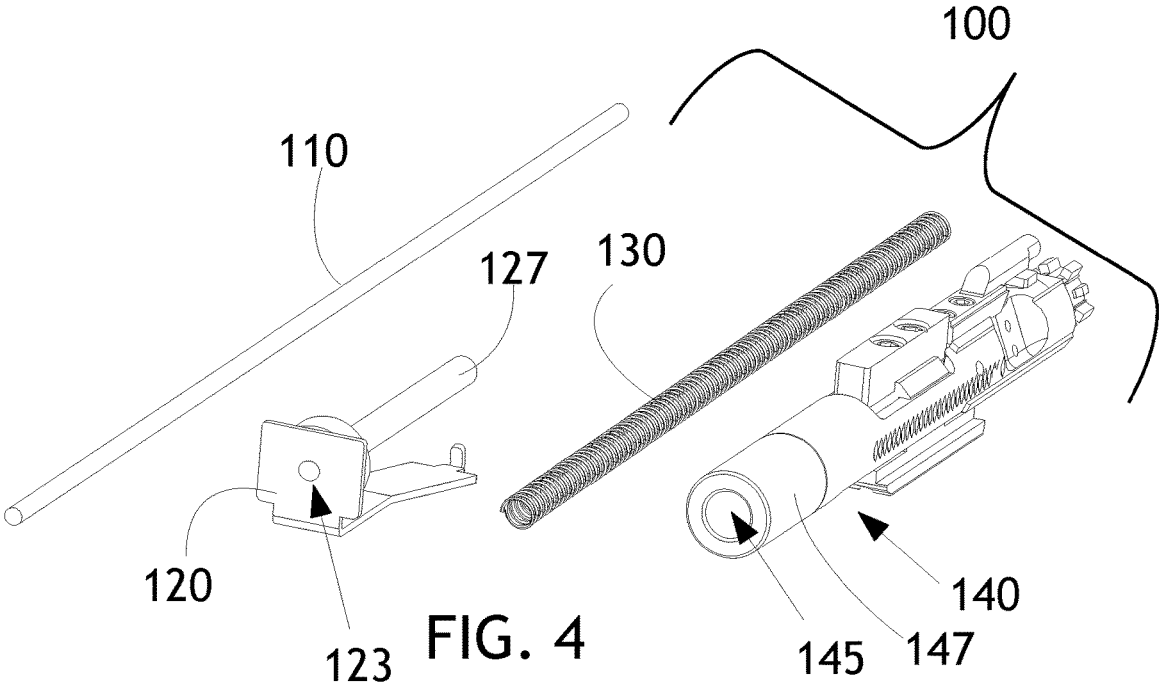
FIG. 4 is an alternate exploded view of the bolt carriage unit and installation rod.
Figure 5:
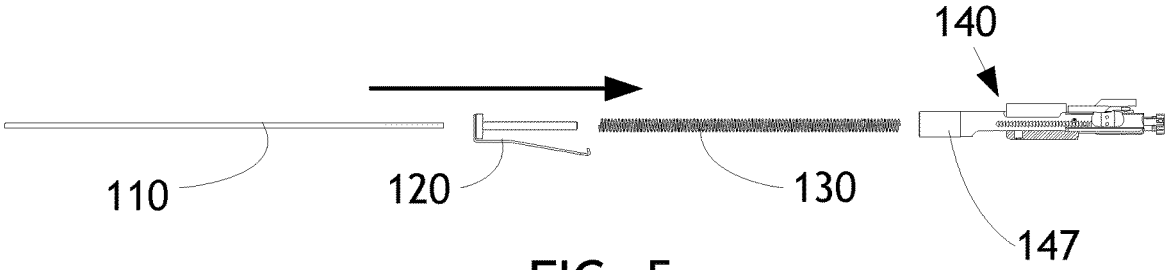
FIG. 5 is a side elevational view of first stage of the assembly of the bolt carriage unit, in partial section.
Figure 6:
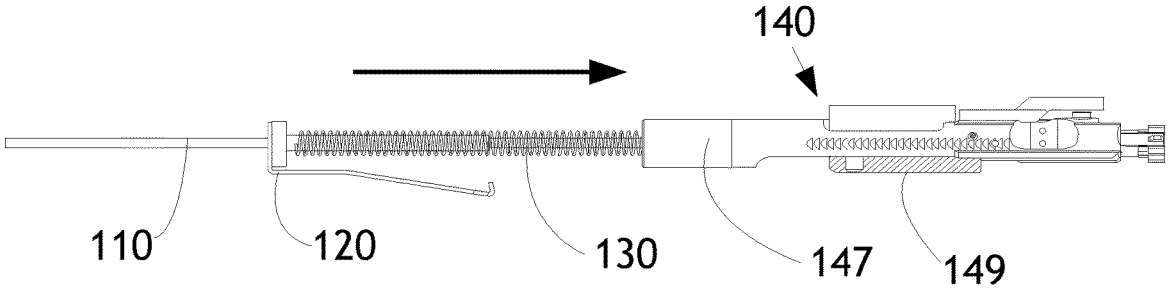
FIG. 6 is a side elevational view of the second stage of the assembly of the bolt carriage unit, in partial section.
Figure 7:
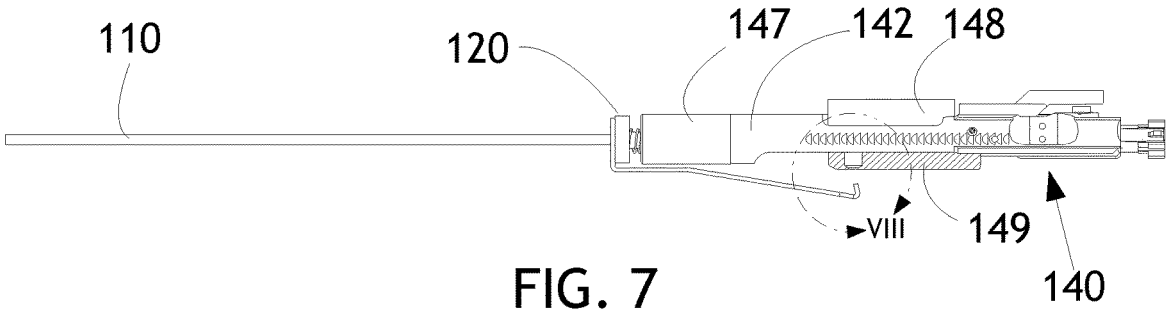
FIG. 7 is a side elevational view of the third stage of the assembly of the bolt carriage unit, in partial section.
Figure 8:
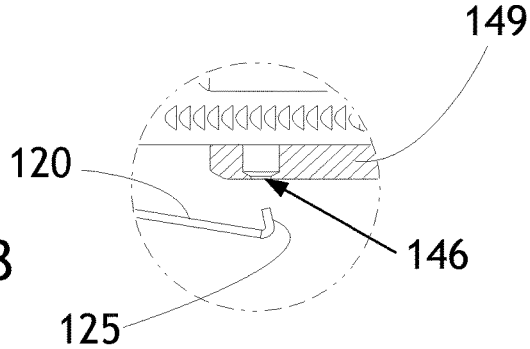
FIG. 8 is a close-up view of the latch interface shown in circle VII of FIG. 7
Figure 9:
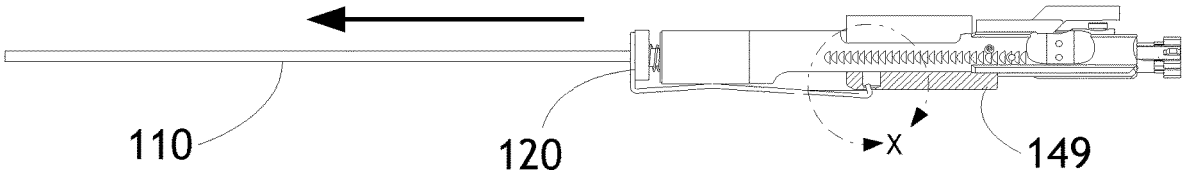
FIG. 9 is a side elevational view of the fourth stage of the assembly of the bolt carriage unit, in partial section.
Figure 10:
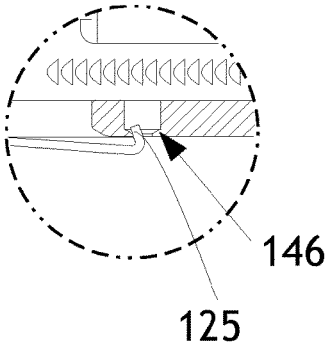
FIG. 10 is a close-up view of the latch interface shown in circle X of FIG. 9.
Figure 11:
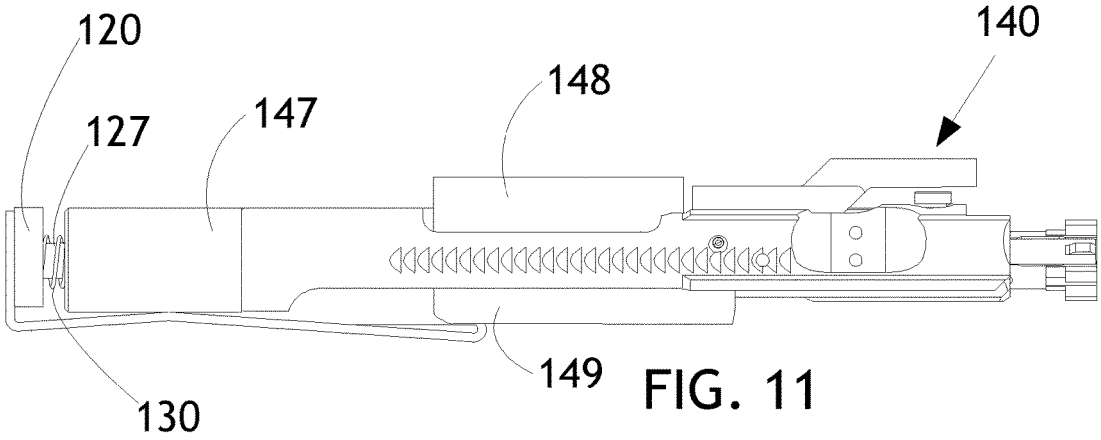
FIG. 11 is a larger-scale side elevational view of the final stage of the assembly of the bolt carriage unit.

With reference to FIG. 1, a MAC firearm has a modified upper receiver 10 and is utilizing a modified AR-15 bolt carrier group 140 placed in a bolt carriage unit 100 in order to effectively operate. A conventional AR-15 bolt carrier group 40, shown in FIG. 2A, comprises a bolt 141 residing in a bolt carrier 142 with a firing pin 143 coaxial to both the carrier 142 and bolt 141, along with other components. A modified bolt carrier group 140, shown in FIG. 2B, comprises a bolt carrier insert 147 residing in a conventional AR-15 bolt carrier group 40 coaxial to each other with sear plate 149 and sear clamp 148 attached. The bolt carriage unit 100 (Shown exploded in FIGS. 3 & 4) also comprises a recoil spring 130 and a latch 120. Its assembly is shown in FIGS. 5-11. An installation rod 110 is inserted through a bore 123 in the head of the latch 120, guided through a support post 127 and through the recoil spring 130, and then into a bore 145 in the back of bolt carrier insert 147 (FIGS. 4-6). The recoil spring 130 is inserted over the latch's support post 127 into the bolt carrier insert's bore 145 and compressed by the latch 120 (FIGS. 7 & 8) until the spring-loaded latch tail 125 is made to interface with a corresponding notch 146 in the sear plate 149 that is attached to AR-15 bolt carrier 142 (FIGS. 9 & 10). Once the bolt carrier group 140 is latched, the installation rod 110 may be removed. The spring-loaded latch tail 125 is held in place by hooking onto a lip of the notch 146 and remains there due to the spring pressure of the recoil spring 130. Normally, the latch tail 125 would be biased away from the bolt carrier group 140 but is forced into position by the user on assembly. The recoil spring 130 is nested around the latch post 127 and in the bolt carrier insert's bore 145, with the support post 127 at least partially inserted in the bolt bore to hold the unit together (FIG. 11).

Figure 12:
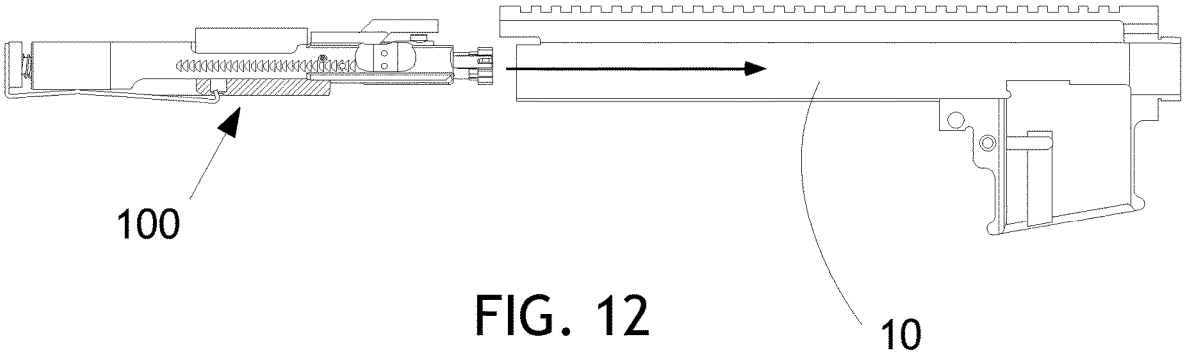
FIG. 12 is a side elevation of the bolt carriage assembly being seated in the upper receiver, in partial section.
Figure 13:
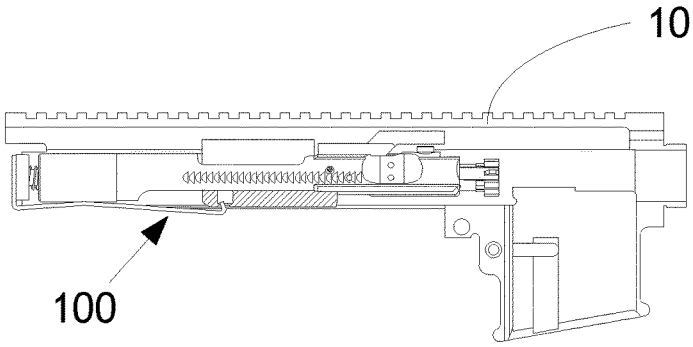
FIG. 13 is a side elevation of the bolt carriage assembly seated in the upper receiver, in partial section.
Figure 14:
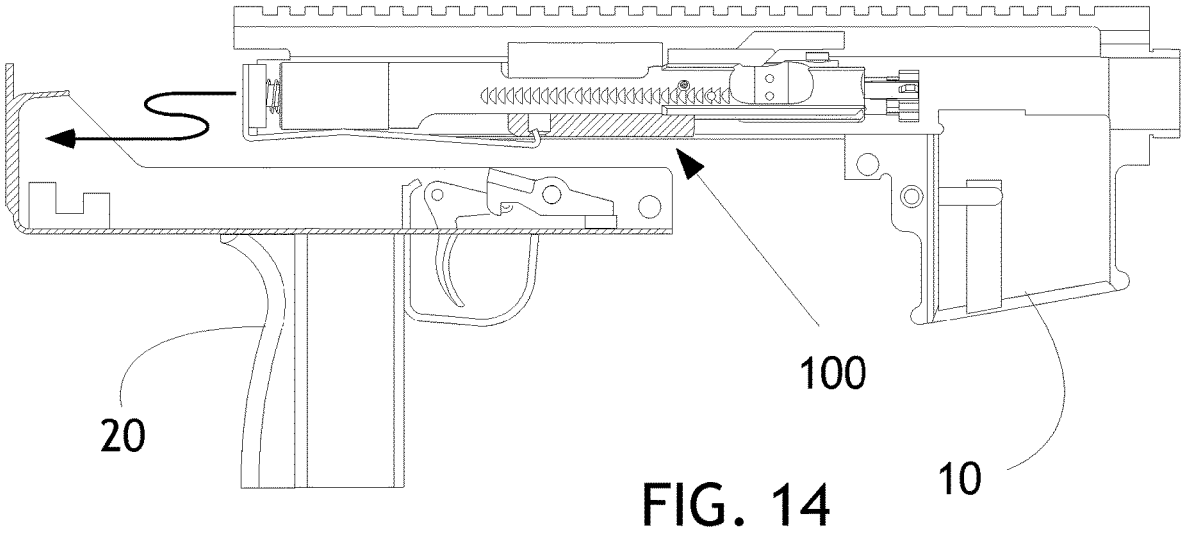
FIG. 14 is a side elevation of the upper receiver, and associated bolt carriage assembly, being seated on a lower receiver, in partial section.
Figure 15:
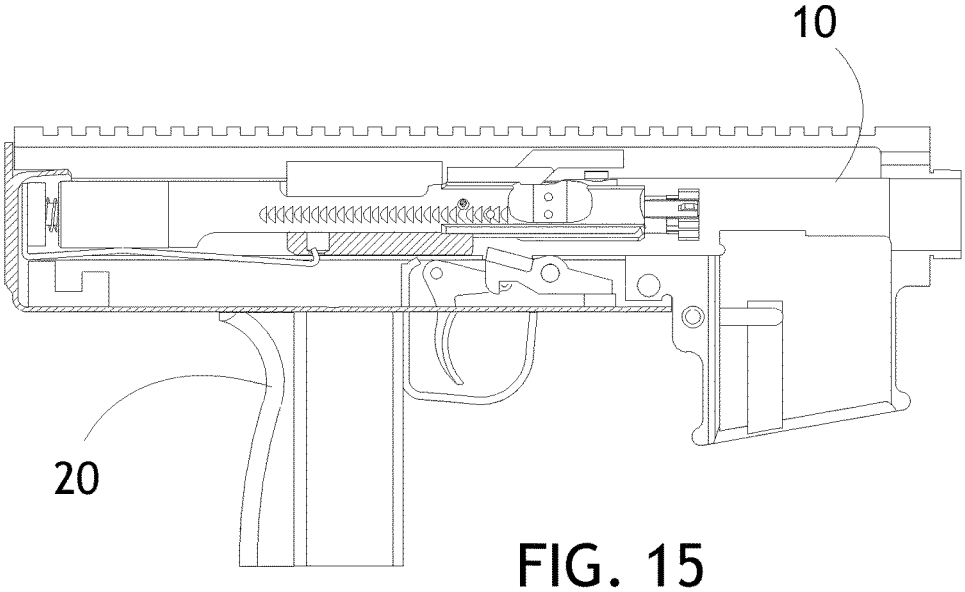
FIG. 15 is a side elevation of the upper receiver seated in the lower receiver, in partial section.
Figure 16:
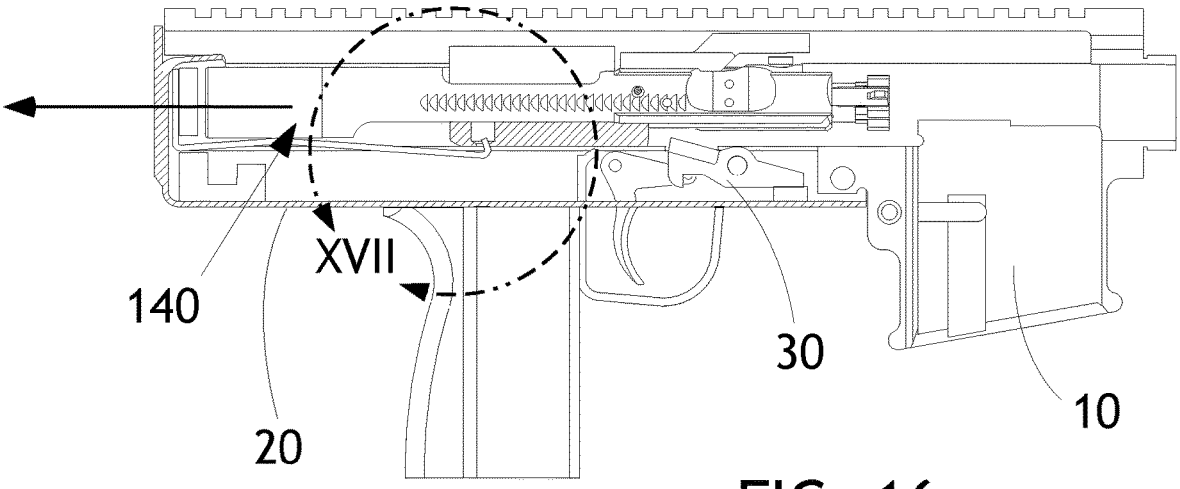
FIG. 16 is a side elevation of the bolt being retracted, in partial section.
Figure 17:
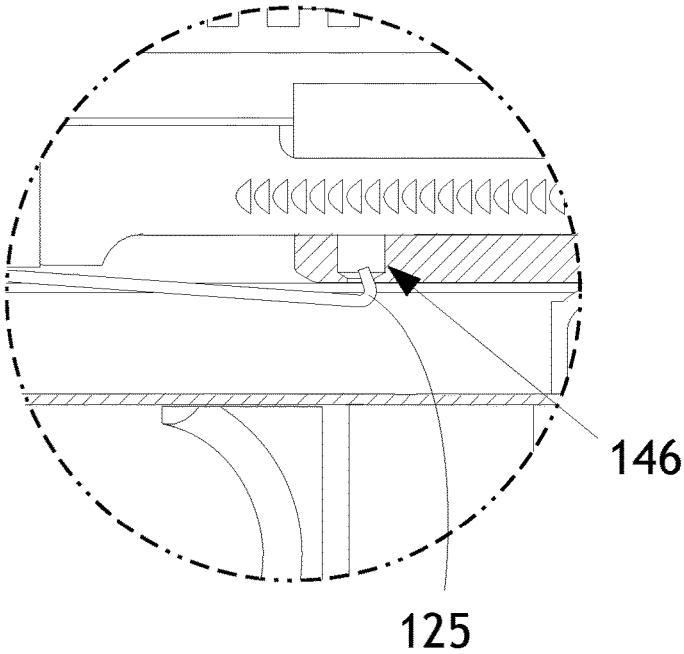
FIG. 17 is a close-up view of the bolt and upper receiver, taken in circle XVII of FIG. 16.
Figure 18:
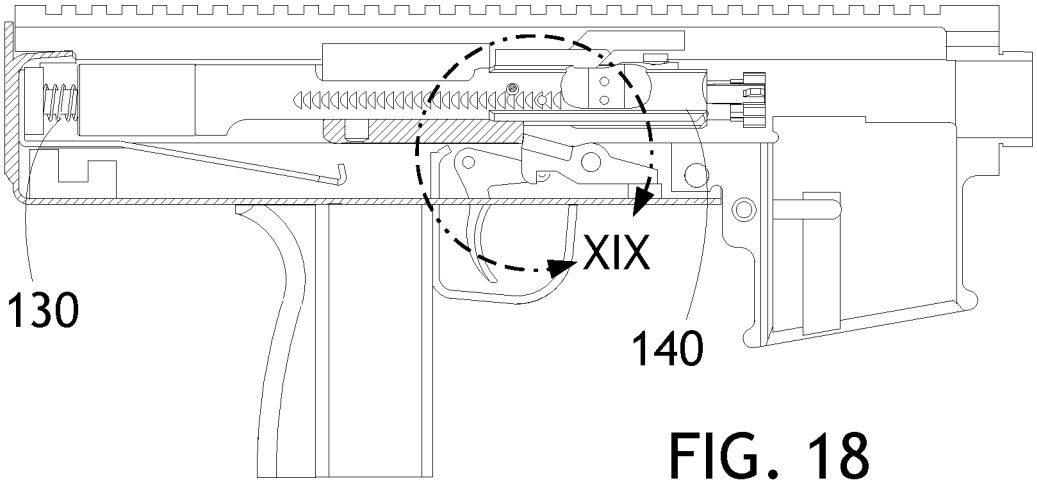
FIG. 18 is a side elevation of the bolt and sear with the bolt being released after retraction, in partial section.
Figure 19:
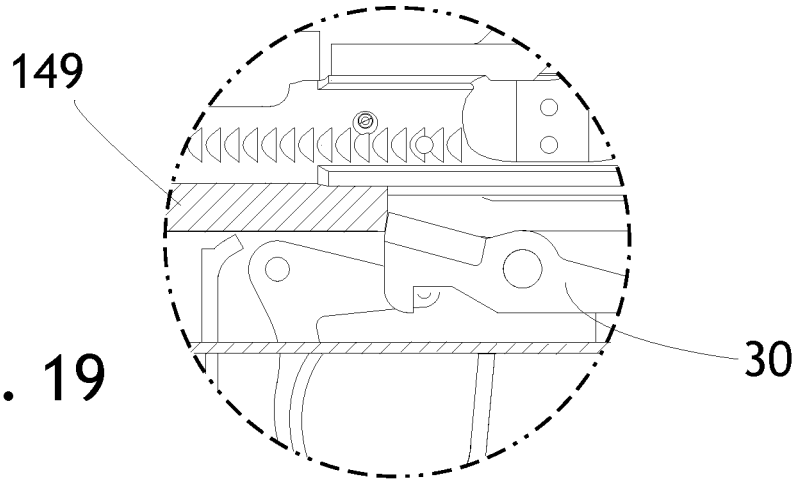
FIG. 19 is a close-up view of the bolt and sear, taken in circle XIX of FIG. 18.

At this stage, the bolt carriage unit 100 may be positioned in the upper receiver 10 for final assembly (FIGS. 12 and 13). The upper receiver 10 is fastened to the lower receiver 20 (FIGS. 14 and 15) and the modified AR-15 bolt carrier group 140 retracted (FIGS. 16 and 17) to compress recoil spring 130 and free the latch 120. The recoil spring 130 then biases the modified AR-15 bolt carrier group 140 forward so it rests on the sear 30 of the firearm and the system is now operational (FIGS. 18 and 19). For disassembly, recoil spring 130 is compressed and then the latch tail 125 may be reattached to the corresponding notch 146 in the sear plate 149, allowing removal.

Figure 20:
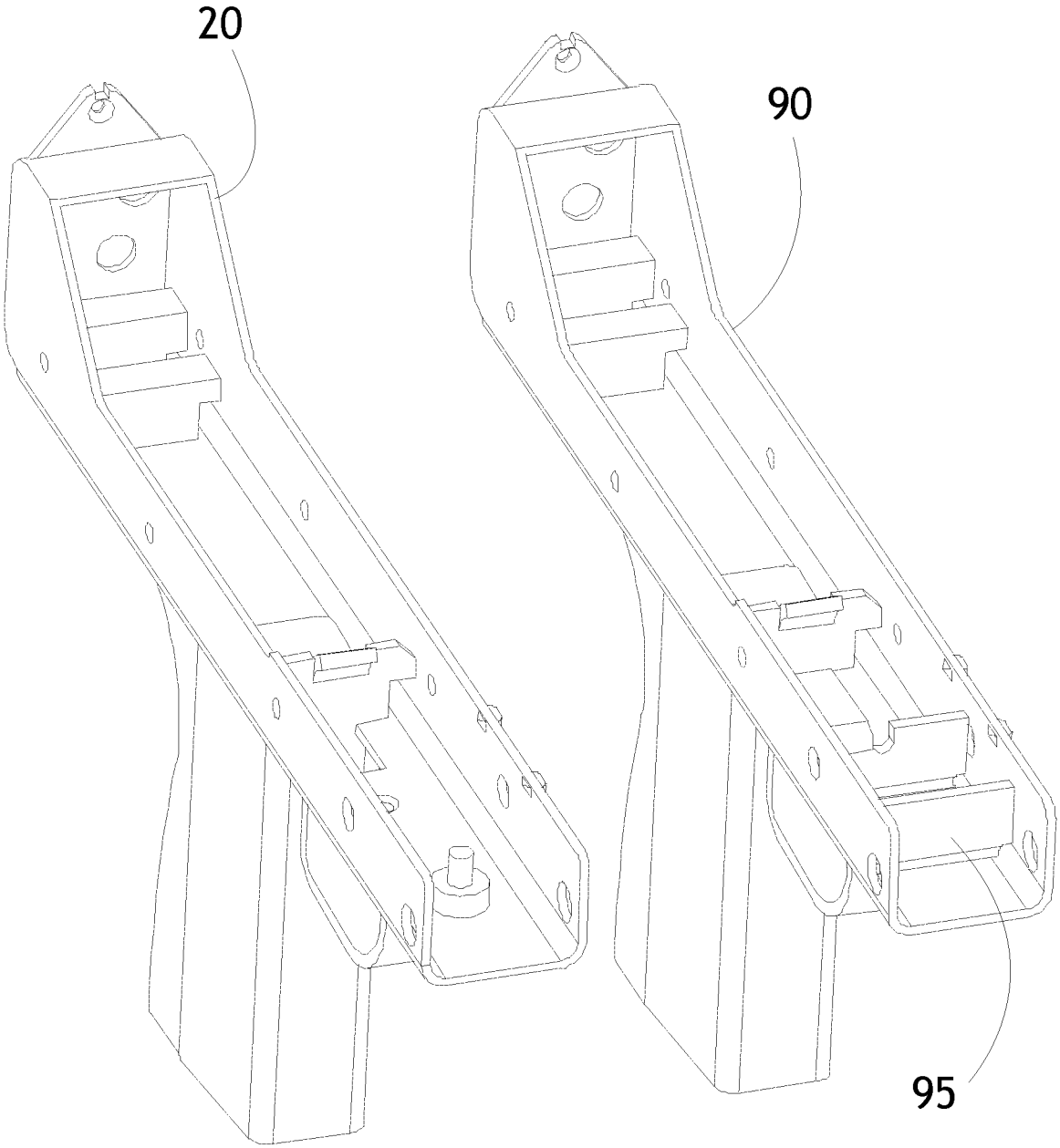
FIG. 20 is a side-by-side perspective view of automatic and semi-automatic lower receivers.
Figure 21:
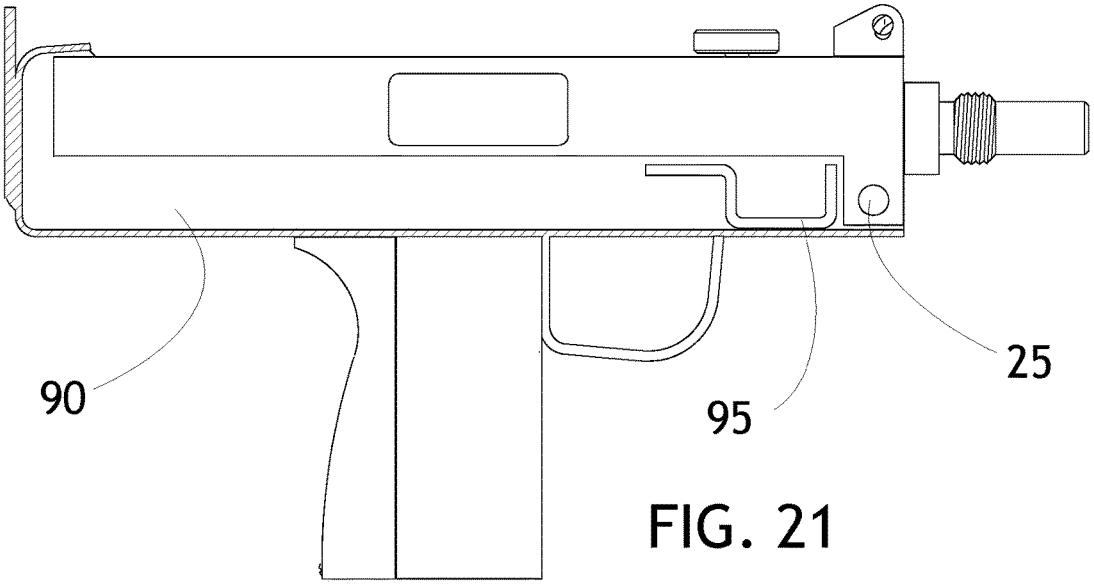
FIG. 21 is a side elevation, in partial section, depicting a semi-automatic lower receiver being used with an OEM semi-automatic upper receiver.
Figure 22:
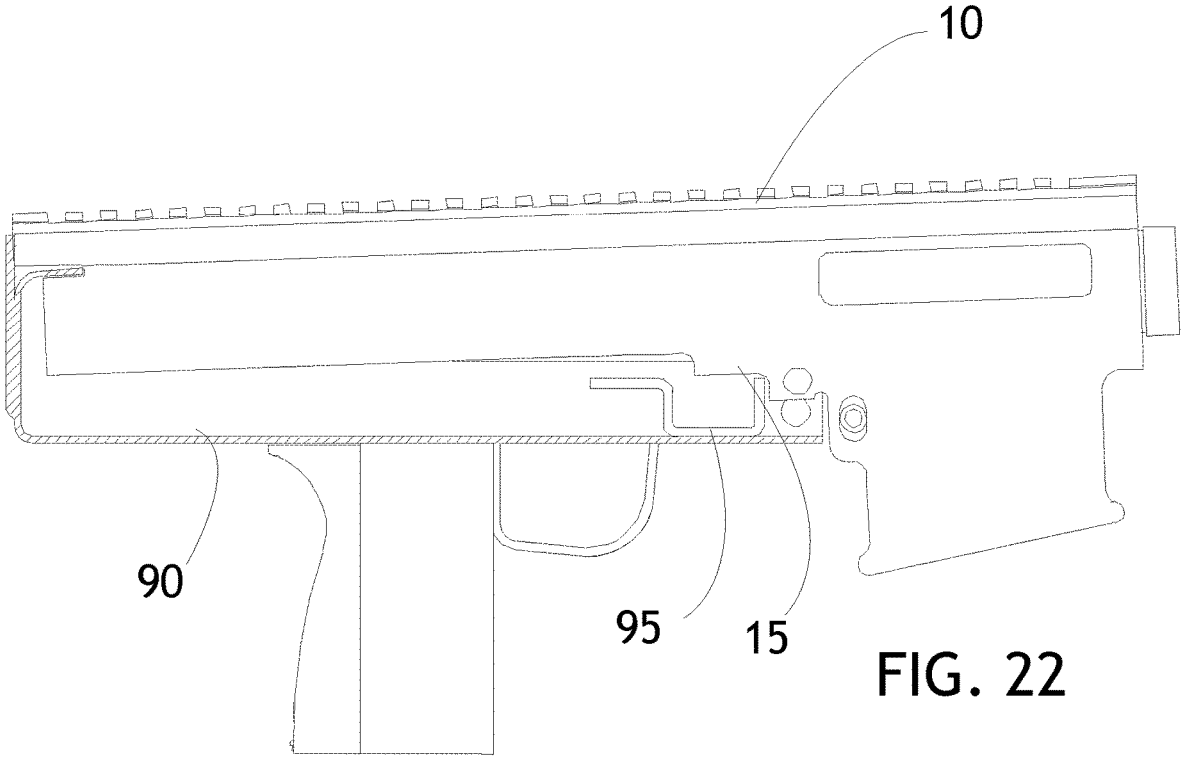
FIG. 22 is a side elevation, in partial section, depicting the lack of interface between an upper receiver of the present invention and a semi-automatic lower receiver.

It is desirable that this invention is not used in the semi-automatic versions of the MAC firearms family. There are current legal and regulatory prohibitions which would cause great disadvantage to the user should this modification be allowed on the semi-automatic MAC weapons. Both variants utilize a simple locking pin interface 25 at the forward end of the joined receiver. FIG. 20 shows a side-by-side perspective view of automatic 20 and semi-automatic 90 lower receivers. As can be seen in the semi-automatic lower receiver 90, geometry 95 is added which is not present in the automatic lower receiver 20. The use of such geometry 95 is a common tactic to prevent misuse of semi-automatic components with fully automatic firearms. A receiver block 15 (behind the magazine well) is added to the forward section of the upper receiver 10 which prevents the two receiver components from being compatible. Where a true semi-automatic upper receiver would fit perfectly (FIG. 21), the present invention's receiver would not (FIG. 22). It should also be noted that the upper receiver of the present invention is also configured to fit the bolt carriage assembly of the present invention.

Although the present invention has been described with reference to preferred embodiments, numerous modifications and variations can be made and still the result will come within the scope of the invention. While the depicted embodiment utilizes a MAC firearm and an AR-15 bolt, it should be readily conceived that multiple firearm platforms may utilize the principles taught by the invention and the invention should not be read to be applicable to only these firearms and components. No limitation with respect to the specific embodiments disclosed herein is intended or should be inferred.

What is claimed is:

1. A bolt conversion apparatus for a firearm to be modified, the apparatus comprising:

a bolt that is of a different type than a bolt for the firearm being modified, said bolt defining a longitudinal axis;

a bolt carrier body, in which the bolt resides, having a bore along the longitudinal axis;

a bolt carrier insert comprising a longitudinal bore, the bolt carrier insert attached to a rear of the bolt carrier body, the longitudinal bore coaxial with the bore of the bolt carrier body;

a sear plate comprising a notch, the sear plate attached to an underside of the bolt carrier body;

an installation rod, a recoil spring;

a latch comprising a spring support post and a tail which selectively interacts with the bolt carrier insert and the sear plate respectively;

wherein the installation rod is first inserted through the spring support post of the latch and the recoil spring and then into the bores of the bolt carrier insert and bolt carrier body, the recoil spring compressed until the latch tail engages the sear plate notch, whereupon the installation rod may then be removed.

2. The bolt conversion apparatus of claim 1, further comprising a replacement upper receiver.

3. The bolt conversion apparatus of claim 2, the replacement upper receiver further comprising a block to prevent interaction with unauthorized lower receivers.

4. The bolt conversion apparatus of claim 1, the tail of the latch being spring-loaded away from the bolt and being held in place by spring pressure by the recoil spring acting between the bolt and the latch.

5. The bolt conversion apparatus of claim 4, further comprising a replacement upper receiver.

6. The bolt conversion apparatus of claim 5, the replacement upper receiver further comprising a block to prevent interaction with unauthorized lower receivers.

7. The bolt conversion apparatus of claim 4, further comprising a bolt carrier group in which the bolt resides.

8. A method of modifying a firearm to accept a bolt not of a type normally associated with the firearm, the method comprising:

providing the bolt conversion apparatus of claim 1;

inserting the installation rod through the support post and recoil spring, and into the bores of the bolt carrier insert and the bolt carrier body;

compressing the latch against the recoil spring and bolt and causing the latch tail to engage the sear plate notch; and removing the installation rod and allowing spring pressure from the recoil spring to hold the latch in engagement with the sear plate notch.

9. The method of claim 8, whereby attachment of the sear plate to the underside of the bolt carrier body is accomplished by attaching a sear clamp to the sear plate.

* * * * *